United States Patent [19]

Oyama

[11] 4,433,478

[45] Feb. 28, 1984

[54] METHOD OF AND APPARATUS FOR ATTACHING BOTTOM STOPS TO A SLIDE FASTENER CHAIN

[75] Inventor: Yoshio Oyama, Asahi, Japan

[73] Assignee: Yoshida Kogyo K. K., Tokyo, Japan

[21] Appl. No.: 360,932

[22] Filed: Mar. 23, 1982

[30] Foreign Application Priority Data

Mar. 24, 1981 [JP] Japan ..... 56-42625

[51] Int. Cl.[3] ..... A41H 37/06; B21D 53/50; B21D 53/52; A44B 19/00

[52] U.S. Cl. ..... 29/767; 29/408; 29/410; 29/766; 24/436

[58] Field of Search ..... 24/205.11 R; 29/33.2, 29/408, 410, 766, 767, 768, 409

[56] References Cited

U.S. PATENT DOCUMENTS

| | | | |
|---|---|---|---|
| 2,096,685 | 10/1937 | Osgood | 29/767 |
| 2,884,691 | 5/1959 | Rath et al. | 29/408 |
| 3,689,980 | 9/1972 | Oyama | 29/767 |
| 3,863,321 | 2/1975 | Perlman | 29/767 |
| 4,217,685 | 8/1980 | Seki | 29/408 |
| 4,332,071 | 6/1982 | Takahashi | 29/408 |

*Primary Examiner*—Howard N. Goldberg
*Assistant Examiner*—Steven Nichols
*Attorney, Agent, or Firm*—Hill, Van Santen, Steadman & Simpson

[57] ABSTRACT

A method of attaching bottom stops of a generally H-shaped cross section to a slide fastener chain. One of successive spaced pairs of opposed blank tape portions of the fastener chain is spread apart. A bottom stop, which has two pairs of gripping legs, is placed between the spread pair of opposed blank tape portions. The spread pair of opposed blank tape portions is then released and thereby allowed to come toward each other until a pair of opposed blank beaded tape edges are threaded one through a space between each pair of the gripping legs of the bottom stop. Then, the blank beaded tape edges are compressed against the bottom stop on opposite sides. Finally, the gripping legs of each pair are clinched about the compressed beaded edge of a respective one of the stringer tapes. An apparatus for carrying this method is also disclosed.

10 Claims, 22 Drawing Figures

METHOD OF AND APPARATUS FOR ATTACHING BOTTOM STOPS TO A SLIDE FASTENER CHAIN

BACKGROUND OF THE INVENTION

1. Field of the Invention

The present invention relates to the production of slide fasteners, and more particularly to a method of and an apparatus for attaching bottom stops to a slide fastener chain.

2. Prior Art

In the slide fastener industry, it is known to attach bottom stops of a generally H-shaped cross section to a slide fastener chain having successive spaced pairs of opposed element-free or blank tape portions between successive spaced pairs of coupling element groups mounted on a pair of stringer tapes along beaded edges thereof; one bottom stop at a time is attached adjacent to the leading or trailing end of one of the successive pairs of coupling element groups. The H-shaped bottom stop has two pairs of gripping legs on opposite sides. For attachment, the beaded tape edges of an adjacent pair of opposed blank tape portions are respectively threaded through a space between the gripping legs of each pair, and the gripping legs of each pair are then simply clinched about a respective one of the beaded tape edges. The major problem with the prior art is that the element-free beaded tape edges, which usually bulge especially at portions adjacent to the coupling element groups, tend to objectionably project out of the inter-leg spaces of the individual bottom stops when the latter are attached. With the prior art, proper and firm attachment of bottom stops to a slide fastener chain is difficult to achieve. Further, the resultant slide fasteners are unpleasant in appearance.

SUMMARY OF THE INVENTION

According to the present invention, a bottom stop having two pairs of gripping legs is attached to a slide fastener chain in the following manner. One of successive pairs of opposed blank tape portions of the fastener chain is spread apart. The bottom stop is placed between the spread pair of opposed blank tape portions. The spread pair of opposed blank tape portions is then released and thereby allowed to come toward each other until a pair of opposed beaded tape edges is threaded through a space between each pair of the gripping legs of the bottom stop. Then, the opposed beaded tape edges are forced or compressed against the bottom stop on opposite sides. Finally, each pair of the gripping legs of the bottom stop is clinched about the compressed tape edge of a respective one of the stringer tapes.

The spreading, releasing and compressing steps mentioned above are accomplished by a pair of grippers each having a pair of relatively movable grip members for gripping a respective one of the stringer tapes. The two grippers are disposed one on each side of the path of the fastener chain and are movable between a "spreading" position in which the grippers are spaced away from one another with a maximal distance therebetween and in which the grip members of each gripper are closed, a "neutral" position in which the grippers are spaced apart from one another with an intermediate distance therebetween and in which the grip members of each gripper are opened, and a "compressing" position in which the grippers are close to one another with a minimal distance therebetween and in which the grip members of each gripper are closed.

It is therefore an object of the present invention to provide a method of attaching bottom stops of a generally H-shaped cross section to a slide fastener chain without projection of the beaded tape edges out of the inter-leg spaces of the individual bottom stops.

Another object of the invention is to provide a method of attaching bottom stops of a generally H-shaped cross section to a slide fastener chain with improved firmness.

Still another object of the invention is to provide an apparatus for carrying out the method mentioned above.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
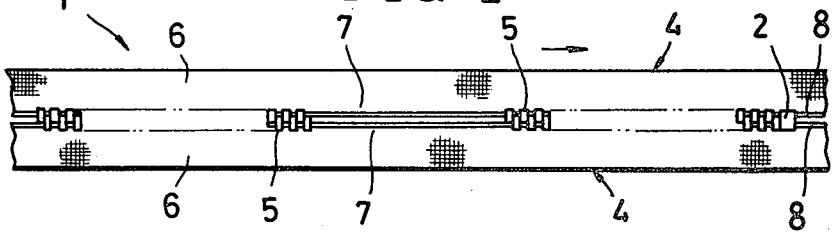
FIG. 1 is a fragmentary plan view of a slide fastener chain to which a bottom stop has been attached in accordance with the present invention.
Figure 2:
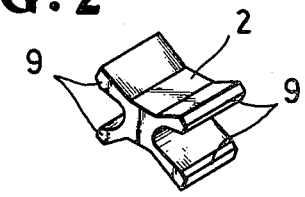
FIG. 2 is an enlarged perspective view of a bottom stop to be attached to the fastener chain.

FIG. 1 shows a slide fastener chain 1 to which a bottom stop 2 has been attached by the method and apparatus 3 (FIG. 14) according to the present invention. The slide fastener chain 1 includes a pair of continuous stringers 4,4, each stringer having successive spaced groups of coupling elements 5 mounted on a continuous stringer tape 6 along a beaded edge 8 thereof and interengaged with opposed complementary groups of coupling elements 5 on the other stringer tape 6, there being successive spaced pairs of opposed blank tape portions 7,7 between the successive spaced pairs of coupling element groups 5,5. The bottom stop 2 has two pairs of gripping legs 9,9;9,9 (FIGS. 2, 10, 11, 12 and 13) at opposite sides.

Figure 13:
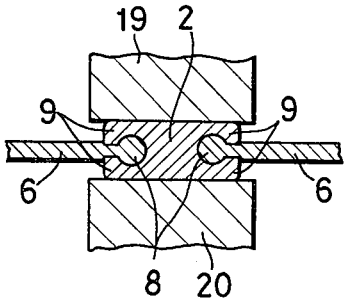
FIG. 13 is an enlarged fragmentary cross-sectional view corresponding to FIG. 9.
Figure 14:
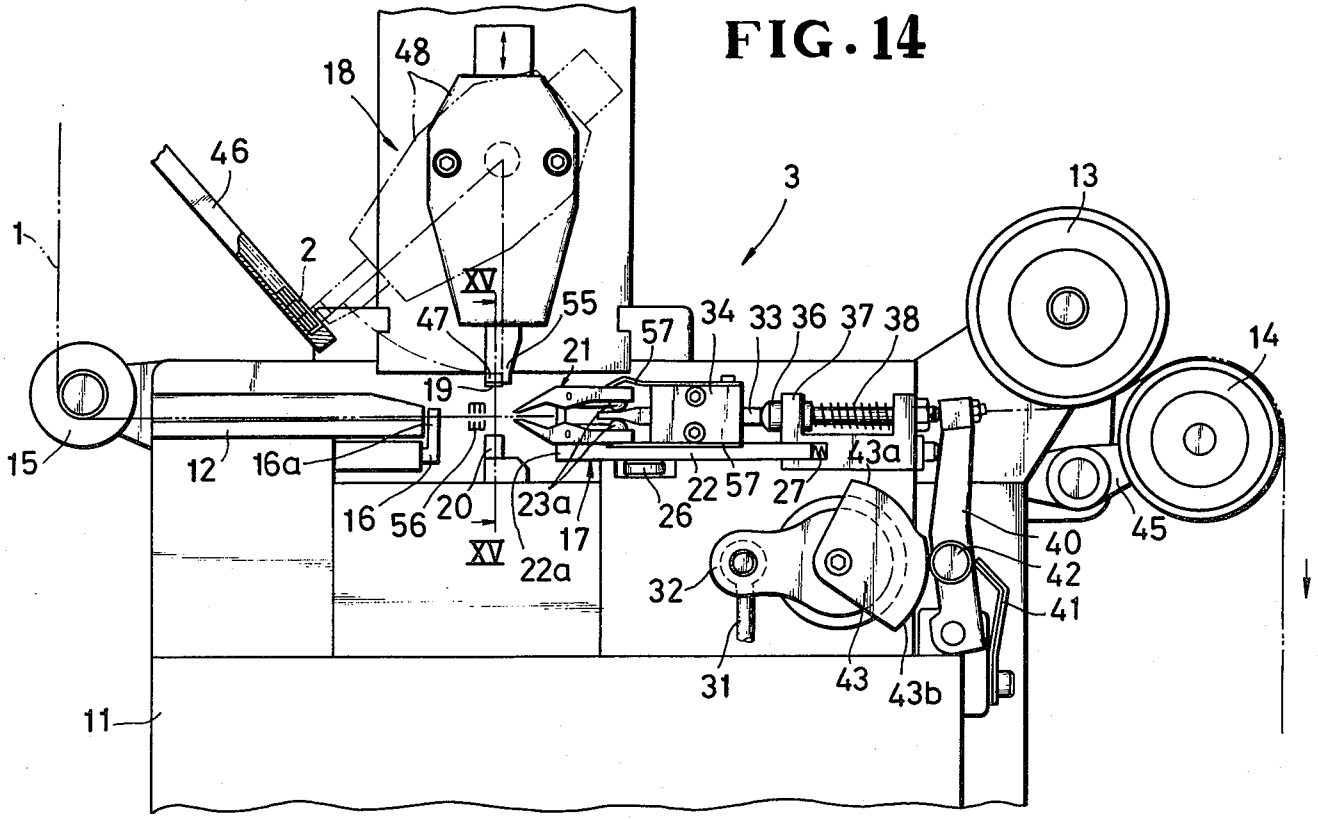
FIG. 14 is a side elevational view, with parts broken away, of an apparatus for carrying out the method.

As shown in FIG. 14, the apparatus 3 generally comprises a frame 11 having a guide table 12 for supporting thereon the fastener chain 1 along a horizontal path, a pair of feed rollers 13,14 and a guide roller 15 disposed downstream and upstream, respectively, of the guide table 12 for moving or feeding the fastener chain 1 longitudinally along the path over the guide table 12 in a predetermined direction, rightwardly in FIG. 14, a feeler lever 16 disposed beneath the path and pivotable with respect to the guide table 12 for sensing the arrival of one of the successive pairs of coupling element groups 5,5 and for terminating the movement of the fastener chain 1 when a predetermined amount of movement has occurred after the sensing, a separator assembly 17 (described below) for separating or spreading apart an adjacent pair of opposed blank tape portions 7,7, and a bottom-stop setting and retaining assembly 18 including a coacting punch and die 19,20 (FIGS. 10–15).

The feeler lever 16 has an upwardly angled tip end **16*a* (FIGS. 14 and 19) and is pivotable between an upper position in which the tip end 16*a* is inserted into a space between the opposed blank tape portions 7,7 of an adjacent pair, and a lower position in which the tip end 16*a* is retracted out of the path. The feeler lever 16 is also horizontally movable along the path between a first position where the tip end 16*a* is inserted into a space between the opposed blank tape portions 7,7 of an adjacent pair, and a second position where the movement of the fastener chain 1 is halted and then the tip end 16*a*** is retracted out of the path.

Figure 16:
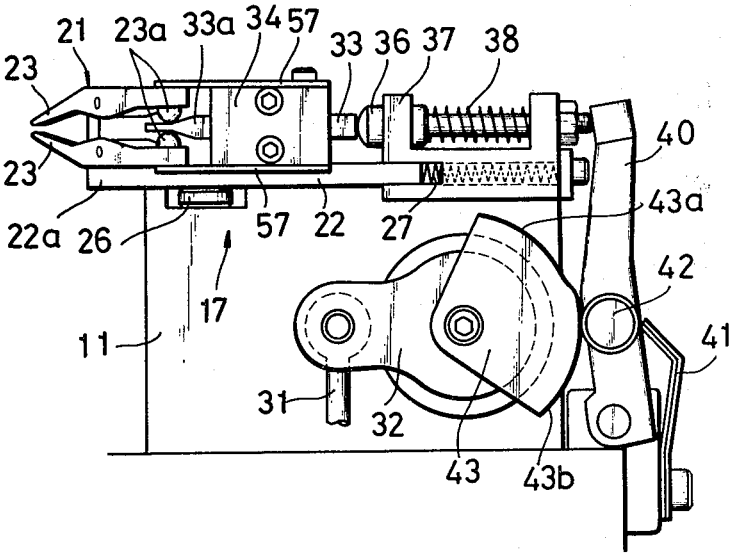
FIG. 16 is an enlarged side elevational view of a pair of grippers and a drive mechanism therefor.
Figure 17:
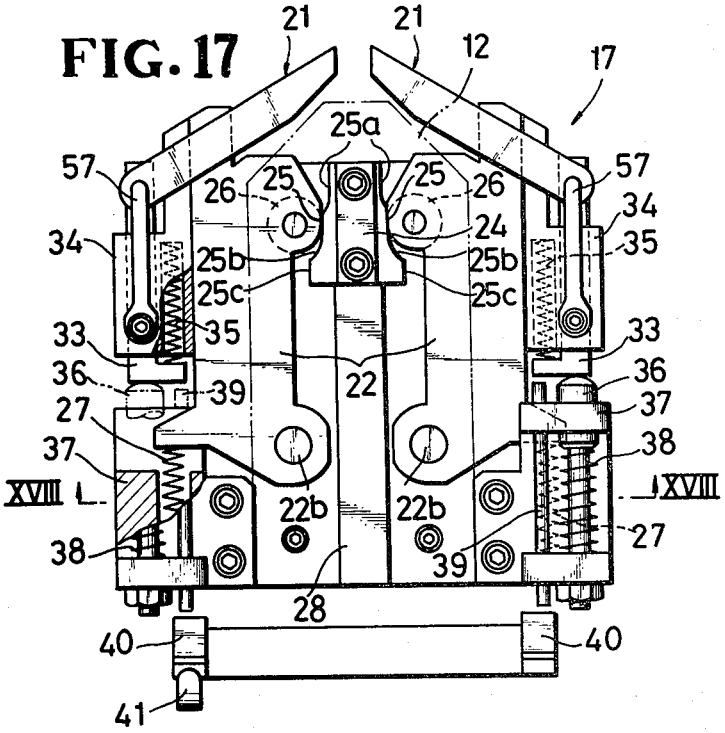
FIG. 17 is a plan view corresponding to FIG. 16.
Figure 19:
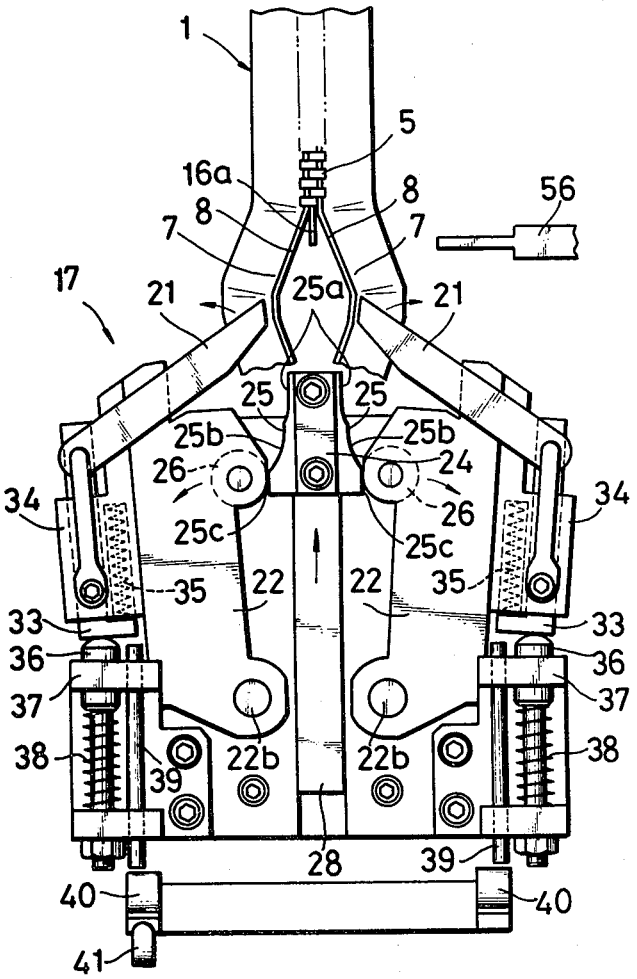
FIG. 19 is a view similar to FIG. 17, showing the grippers positioned away from each other.
Figure 20:
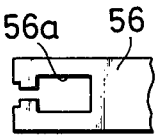
FIG. 20 is a fragmentary enlarged side elevational view of a coupling-element stopping finger shown in FIG. 19.
Figure 21:
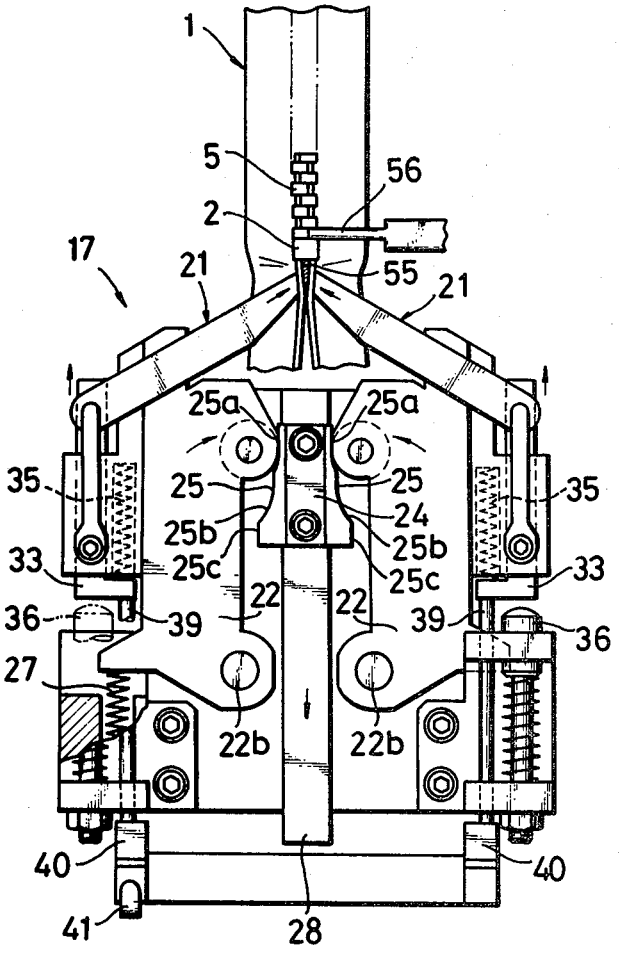
FIG. 21 is a view similar to FIG. 19, showing the grippers positioned close to each other.

As shown in FIGS. 14,16,17 and 19, the separator assembly 17 includes a pair of grippers 21,21 carried on a pair of gripper holders 22,22, respectively, which are pivotally supported on the frame 11 by means of a pair of pins **22*b*,22*b*, respectively, and are disposed one on each side of the path of the fastener chain 1. Each gripper 21 has a pair of relatively movable grip members 23,23 for gripping one of the stringer tapes 6. The grip members 23,23 of each gripper 21 are pivotally mounted on a rear end 22*a* (left end in FIGS. 14 and 16) of a respective one of the gripper holders 22. The two grippers 21,21 extend rearwardly convergently, each gripper 21 being the mirror image of the other with respect to the path, as shown in FIGS. 17,19 and 21. The grippers 21,21 are movable, in response to pivotal movement of the gripper holders 22,22 as described below, between a "spreading" position (FIGS. 4, 5 and 19) in which the grippers 21,21 are spaced away from one another with a maximal distance therebetween, a "neutral" position (FIGS. 3, 6, 7, 9 and 17) in which the grippers 21,21 are spaced apart from one another with an intermediate distance therebetween, and a "compressing" position (FIGS. 8 and 21) in which the grippers 21,21** are close to one another with a minimal distance therebetween.

Figure 18:
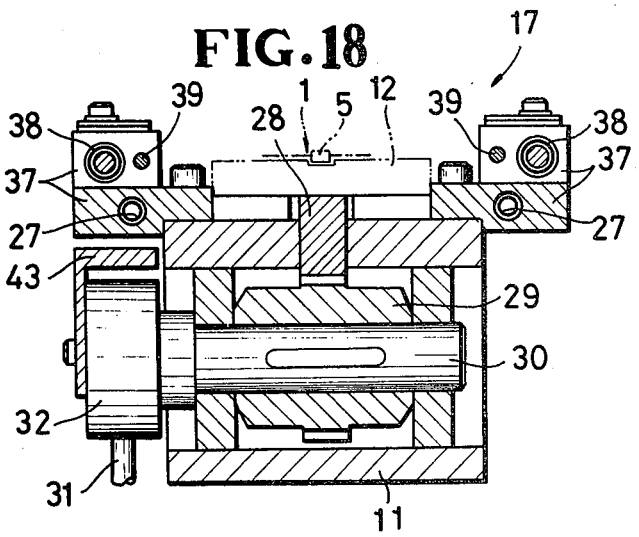
FIG. 18 is a cross-sectional view taken along line XVIII—XVIII of FIG. 17.

Such movement of the grippers 21,21 is regulated by a cam plate 24 (FIGS. 17, 19 and 21). The cam plate 24 has a pair of cam surfaces 25,25 each having a first, a second and a third cam portion **25*a*,25*b*,25*c* (described below). A pair of rollers 26,26 is carried one on each gripper holder 22 and is urged against the cam surfaces 25,25 by a pair of compression springs 27,27, respectively, each spring 27 being mounted between the frame 11 and a respective one of the gripper holders 22. The cam plate 24 is mounted on a rack 28 disposed between the gripper holders 22,22 and meshing with a toothed wheel 29 (FIG. 18) mounted on a shaft 30. The shaft 30 is operatively connected to an actuator rod 31 with a crank 32, as better shown in FIGS. 14, 16, 18 and 22. The actuator rod 31 is vertically movable to turn the shaft 30 and thus the toothed wheel 29 through a predetermined angle, thus causing the rack 28 to move longitudinally between the position of FIG. 19 and the position of FIG. 21 via the position of FIG. 17. The rollers 26,26 of the gripper holders 22,22 roll along the cam surface 25,25, respectively, from the first cam portion 25*a* to the third cam portion 25*c* via the second cam portion 25*b* while the rack 28 is moved from the position of FIG. 21 to the position of FIG. 19 via the position of FIG. 17. During that time, the grippers 21,21** are moved from the "compressing" position to the "spreading" position via the "neutral" position.

Figure 22:
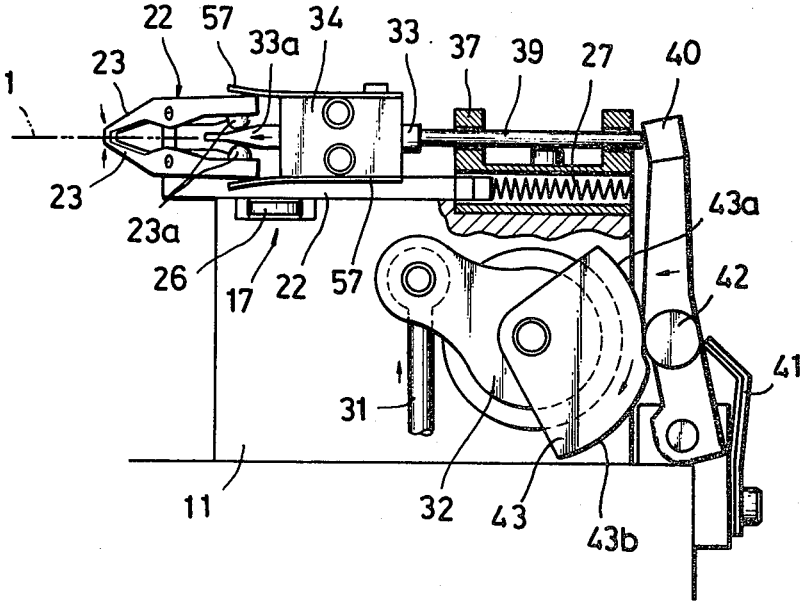
FIG. 22 appearing with FIGS. 1 and 2 is a side elevational view partly in cross section corresponding to FIG. 21.

The closing and opening of the opposed grip members 23,23 of each gripper 21 is controlled as follows. As shown in FIGS. 14, 16 and 22, the grip members 23,23 are normally urged to open by a pair of leaf springs 57,57 and have a pair of opposed hemispherical projections **23*a*,23*a* at respective outer ends, which are in engagement with a cam bar 33 on its tapering end 33*a*. The cam bar 33 is slidably carried by a wing 34 of a respective one of the gripper holders 22 and is movable between an advanced position in which the grip members 23,23 are closed, and a retracted position in which the grip members 23,23 are opened. The cam bar 33 is normally urged to move rightwardly in FIGS. 14,16 and 22 by a compression spring 35 (FIGS. 17, 19 and 21). Such rightward movement of the cam bar 33 is restricted by a stop 36 adjustably supported by a bracket 37 fixed to the frame 11. The stop 36 is normally urged against the cam bar 33 by a compression spring 38 having a biasing force greater than that of the spring 35. The stop 36 serves to push the cam bar 33 to its advanced position when the gripper holder 22 is pivotally moved to the "spreading" position. Also supported by the bracket 37 is a pushing bar 39 for pushing the cam member 33 to the advanced position against the biasing force of the spring 35. An actuator lever 40 is pivotally mounted on the frame 11 and is pivotable between a "closing" position in which the pushing bar 39 and thus the cam bar 33 are moved to the advanced position, and an "opening" position in which the pushing bar 39 and thus the cam bar 33 are allowed to come back to the retracted position. The actuator lever 40 is normally urged to pivot counterclockwise in FIGS. 14,16 and 22 by a leaf spring 41. Thus a roller 42 on the actuator lever 40 is urged against a cam sector 43 mounted on the shaft 30 (FIG. 18), the cam sector 43 having a minor-diameter portion 43*a* and a major-diameter portion 43*b*. The roller 42 rolls along the minor- and major-diameter cam portions 43*a*,43*b* as the shaft 30 is turned through an angle in response to the vertical movement of the actuator rod 31**.

As shown in FIG. 14, one of the feed rollers 13 is a drive roller adapted to be driven for rotation at a constant speed. The other roller 14 is an idle roller mounted on an arm 45 pivotally supported on the frame 11. The idle roller 14 is movable toward and away from the drive roller 13 in response to the pivotal movement of the arm 45. The arm 45 is pivotable clockwise, in response to the arrival of one of the successive pairs of coupling element groups 5,5, to cause the idle roller 14 to move away from the drive roller 13, thereby relaxing the fastener chain 1 so that an adjacent pair of opposed blank tape portions 7,7 is spread apart without disengagement of the adajcent coupling elements 5,5.

The bottom-stop setting and retaining assembly 18, as shown in FIG. 14, comprises a chute 46 for carrying a succession of the bottom stops 2, and a holder 47 for receiving one bottom stop 2 at a time from the chute 46 and for then delevering the bottom stop 2 to a fixed point at which it is to be attached to the fastener chain 1. The holder 47 is supported by a rocking body 48 which is movable between a tilted position (phantom lines) is which one of the bottom stops 2 is transferred from the chute 46 to the holder 47, and a vertical position (solid lines) in which the bottom stop 2 is set at a fixed point, as described below.

Figure 15:
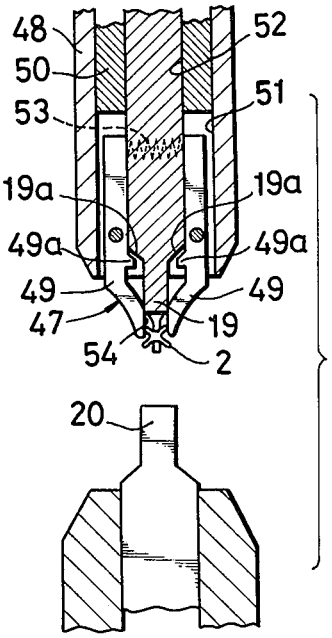
FIG. 15 is an enlarged cross-sectional view taken along line XV—XV of FIG. 14.

As shown in FIG. 15, the holder 47 includes a pair of clamping arms 49,49 pivotally supported by a slide 50 slidably received in a bore 51 extending longitudinally of the rocking body 48. The punch 19 is slidably received in a longitudinal slot 52 of the slide 50 and extends beyond a free end of the rocking body 48. The clamping arms 49,49 extend normally beyond the punch 19 so as to define therewith a pocket 54 for receiving a bottom stop 2 discharged from the chute 46. The clamping arms 49,49 are disposed one on each side of the punch 19 and are normally urged toward one another at their tip ends by a compression spring 53 for resiliently holding the bottom stop 2 in the pocket 54. The punch 19 has a pair of shoulders **19*a*,19*a* which is engageable with a pair of projections 49*a*,49*a* on the clamping arms 49,49, respectively, when the punch 19 is downwardly moved to project beyond the tip ends of the clamping arms 49,49 for forcing the bottom stop 2 out of the pocket 54 and for then retaining the same at the fixed point in cooperation with the die 20. At that time the die 20 is upwardly movable from beneath the path of the fastener chain 1, in timed relation with the downward movement of the punch 19, toward the fixed point. A ram (not shown) is disposed above the punch 19 and is downwardly movable to force the punch 19 toward the die 20 for clinching each gripping legs 9,9 (FIGS. 2, 10, 11 and 12) of the bottom stop 2 about the beaded tape edge 8 of a respective one of the stringer tapes 6**.

Figure 3:
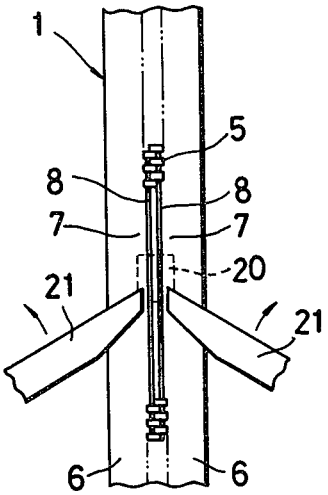
FIG. 3 through FIG. 9 illustrate a sequence of steps according to the present invention.
Figure 4:
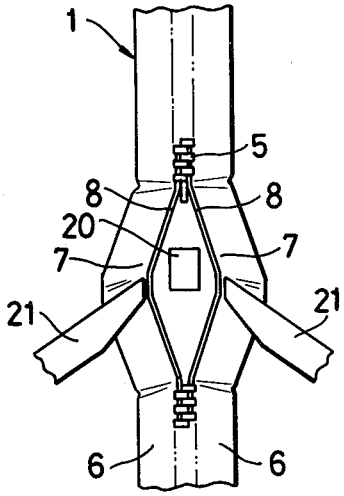

In operation, a slide fastener chain 1 (FIG. 1) is moved forwardly or rightwardly along the path through the apparatus 3 (FIG. 14) via the guide roller 15 by the feed rollers 13,14. When one of the successive pairs of coupling element groups 5,5 arrives, the feeler lever 16 is raised to cause the tip end **16*a* to project into a space between the opposed blank tape portions 7,7 of an adjacent pair. One of the successive pairs of coupling element groups 5,5 then comes into engagement with the tip end 16*a* of the feeler lever 16. With the tip end 16*a* in engagement with the leading end of one of the successive pairs of coupling element groups 5,5, the feeler lever 16 travels forwardly and stops when a predetermined amount of travel has occurred after the arrival of one of the successive pairs of coupling element groups 5,5. The movement of the fastener chain 1 is thus halted (FIG. 3). After that, the feeler lever 16 is lowered to retract the tip end 16*a*** out of the path.

Substantially concurrently with the termination of movement of the fastener chain 1, the actuator rod 31 is moved downwardly to cause the shaft 30 and the toothed wheel 29 (FIG. 18) to turn counterclockwise (FIGS. 14 and 16) through an angle. The rack 28 and the cam member 25 is thus moved from the position of FIG. 17 to the position of FIG. 19, during which time the rollers 26,26 roll from the second cam portions **25*b* onto the third cam portions 25*c*,25*c*, causing the grippers 21,21 to move from the "neutral" position to the "spreading" position. At the same time, the cam bars 33,33 are pushed by the stops 36,36 to the advanced position to cause the grip members 23,23 of each gripper 21 to grip a respective one of the stringer tapes 6. As a result, the opposed blank tape portions 7,7 of an adjacent pair are spread apart (FIG. 4) to such an extent that a bottom stop 2 to be attached to the fastener chain 1 can be set at the fixed point between the opposed blank tape portions 7,7, as described below. During this spreading step, the idle roller 14 is out of engagement with the drive roller 13 to relax the fastener chain 1 so that an adjacent pair of opposed blank tape portions 7,7 is spread apart without disengagement of the coupling elements 5,5** adjacent thereto.

Figure 5:
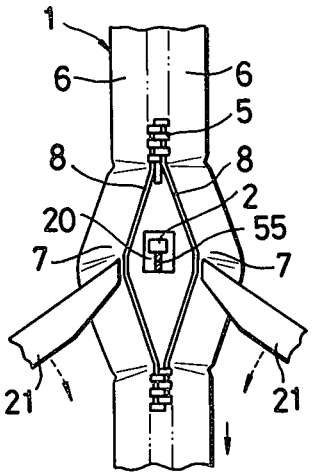
Figure 10:
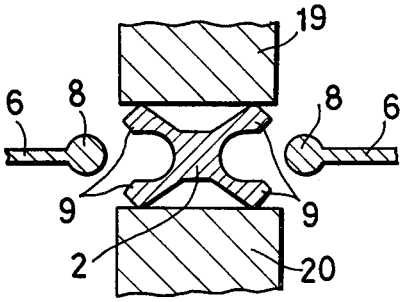
FIG. 10 appearing with FIGS. 3–5 is an enlarged fragmentary vertical cross-sectional view corresponding to FIG. 5.

After the opposed blank tape portions 7,7 have been spread apart by the grippers 21,21, the rocking body 48 with a bottom stop 2 held by the holder 47 is pivotally moved from the tilted position (phantom lines in FIG. 14) to the vertical position (solid lines in FIG. 14). The holder 47 along with the punch 19 is then downwardly moved toward a fixed point between the spread pair of opposed blank tape portions 7,7. Concurrently, the die 20 is upwardly moved to retain the bottom stop 2 at the fixed point in cooperation with the punch 19, as illustrated in FIGS. 5 and 10. At that time, the bottom stop 2 is so located that a space between the gripping legs 9,9 of each pair is opposed to a respective one of the beaded tape edges 8. To assist such proper placing of the bottom stop 2, a bottom stop guide plate 55 (FIGS. 5–9 and 14) is lowered along with the bottom stop 2.

Figure 6:
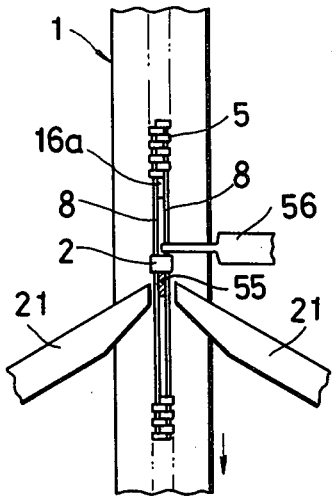
Figure 11:
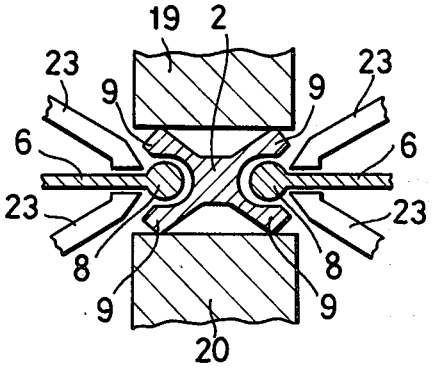
FIG. 11 appearing with FIGS. 6 and 7 is an enlarged vertical fragmentary cross-sectional view corresponding to FIGS. 6 and 7.

The actuator rod 31 is then upwardly moved to turn the shaft 30 and thus the toothed wheel 29 clockwise (FIGS. 14 and 16) through an angle, causing the rack 28 and the cam member 24 to move from the position of FIG. 19 to the position of FIG. 17. At that time, the rollers 26,26 on the gripper holders 22,22 roll from the third cam portions **25*c*,25*c* onto the second cam portions 25*b*,25*b* to cause the gripper holders 22,22 with the grippers 21,21 to be pivotally moved to the "neutral" position, thus allowing the cam bars 33,33 to move to its retracted position. As a result, the grip members 23,23 of each gripper 21 are opened to release the spread pair of opposed blank tape portions 7,7 to thereby allow the same to come toward one another, under the tension of the fastener chain 1, until the opposed beaded tape edges 8,8 are threaded through the space between each pair of the gripping legs 9,9 of the bottom stop 2, as shown in FIGS. 6 and 11**.

Figure 7:
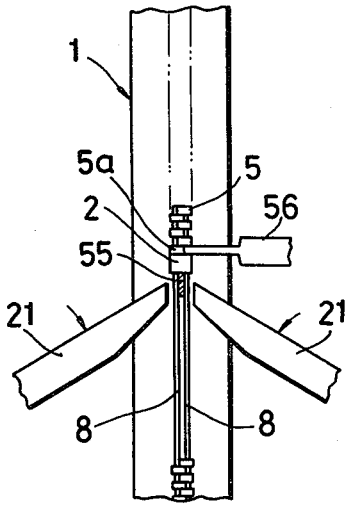
Figure 8:
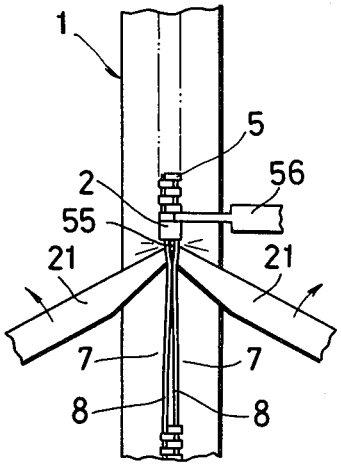
Figure 12:
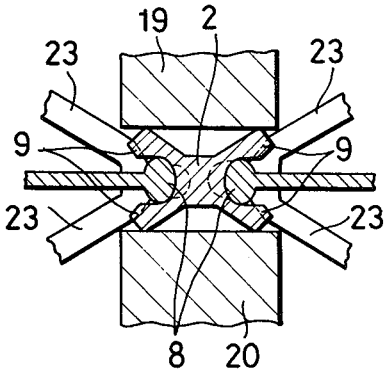
FIG. 12 is an enlarged vertical fragmentary cross-sectional view corresponding to FIG. 8.

With the beaded tape edges 8,8 threaded through the bottom stop 2, the fastener chain 1 is further moved forwardly until the leading end of one of the successive pairs of coupling element groups 5,5 reach the bottom stop 2, as shown in FIG. 7. At that time, a coupling-element stop finger 56 (FIGS. 6–9, 19 and 20) is locatable adjacent to the bottom stop 2 in transverse alignment with the endmost coupling element **5*a* (FIG. 7) so that the bottom stop 2 is kept in proper posture for correct attachment to the fastener chain 1, the stop finger 56 having a cutout 56*a***.

With continued upward movement of the actuator rod 31 in FIGS. 14 and 16, the shaft 30 with the tooth wheel 29 is further turned clockwise through an angle, thus causing the rack 28 with the cam member 24 to move from the position of FIG. 17 to the position of 21. At that time, the rollers 26,26 roll from the second cam portions **25*b*,25*b* onto the first cam portions 25*a*,25*a* to cause the grippers 21,21 to move to the "compressing" position. At the same time, the cam sector 43 also is turned through the same angle until the roller 42 of the actuator lever 40 comes into engagement with the minor-diameter portion 43*a*, as shown in FIG. 22. Thus the actuator lever 40 is pivotally moved to the "closing" position, pushing the pushing bar 39 and the cam bar 33 to their advanced position. The grip members 23,23 of each gripper 21 are thus closed to grip the opposed blank tape portions 7,7. As a result, the beaded tape edges 8,8 are forced or compressed against the bottom stop 2 on opposite sides (FIGS. 8 and 12), during which time the bottom stop guide plate 55 is disposed between the beaded tape edges 8,8 so that latter are prevented from being tilted with respect to the bottom stop 2**.

Figure 9:
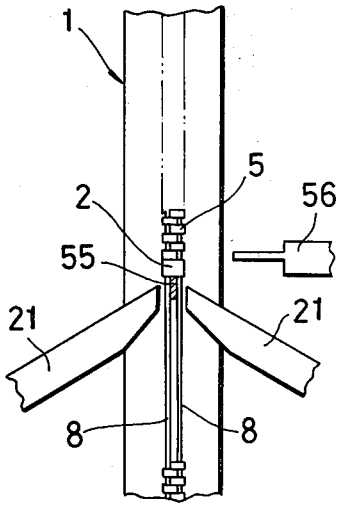

Finally, the punch 19 is further lowered by the ram (not shown) to clinch each pair of the gripping legs 9,9 of the bottom stop 2 about the beaded tape edge 8 of a respective one of the stringer tapes 6, as shown in FIGS. 9 and 13.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for attaching bottom stops to a slide fastener chain including a pair of continuous stringers, each stringer having successive spaced groups of coupling elements mounted on a continuous stringer tape along a beaded edge thereof and interengaged with opposed complementary groups of coupling elements on the other stringer tape, the fastener chain having successive spaced pairs of opposed blank tape portions between the successive pairs of coupling element groups, each of the bottom stops having two pairs of gripping legs at opposite sides, said apparatus comprising:

(a) a frame having a guide table for supporting thereon the fastener chain;

(b) means for moving the fastener chain longitudinally along a path over said guide table in a predetermined direction;

(c) means for sensing the arrival of one of the successive spaced pairs of coupling element groups to terminate the movement of the fastener chain;

(d) means responsive to said arrival for spreading apart one of the successive pairs of opposed blank tape portions;

(e) means for placing and retaining one bottom stop at a fixed point between the spaced pair of opposed blank tape portions;

(f) said spreading means being responsive to said setting of said one bottom stop for releasing the spread pair of opposed blank tape portions to thereby allow the same to come toward each other until the opposed beaded tape edges respectively threaded through a space between each pair of the gripping legs of said one bottom stop retained at said fixed point;

(g) said moving means being responsive to said threading for further moving the fastener chain along the path in said predetermined direction until leading endmost coupling elements of said one pair of coupling element groups reach said one bottom stop retained at said fixed point;

(h) said spreading means being responsive to said reaching for compressing the opposed beaded tape edges against said one bottom stop on opposite sides; and (i) said placing and retaining means being responsive to said compressing for clinching each pair of gripping legs of said one bottom stop about the compressed beaded tape edge of a respective one of the stringers.

2. An apparatus according to claim 1, said spreading means comprising a pair of grippers disposed one at each side of the path, each gripper having a pair of relatively movable grip members for gripping a respective one of the stringer tapes, said pair of grippers being movable between a "spreading" position in which said grippers are spaced away from one another with a maximal distance therebetween and in which said grip members of each said gripper are closed, a "neutral" position in which said grippers are spaced apart with an intermediate distance therebetween and in which said grip members of each said gripper are open, and a "compressing" position in which said grippers are close to one another with a minimal distance therebetween and in which said grip members of each said gripper are closed.

3. An apparatus according to claim 2, said spreading means further including means for regulating the movement of said grippers between said "spreading," "neutral" and "compressing" positions, said regulating means comprising a pair of gripper holders pivotally supported on said frame, a cam member disposed between said gripper holders and movable back and forth, and a pair of rollers respectively carried by each said gripper holder, said cam member having a pair of cam surfaces each having a first, a second and a third cam portion of a gradually increasing width, said rollers, in response to the movement of said cam member, being rollable along said first, second and third cam portions to thereby cause said gripper holders and thus said grippers to move toward and away from each other.

4. An apparatus according to claim 3, said regulating means further including means for moving said cam member back and forth, said cam-member moving means comprising a shaft supported by said frame for turning through a predetermined angle, a rack slidably supported on said frame, and a toothed wheel mounted on said shaft and meshing with said rack, said cam member being mounted on said rack.

5. An apparatus according to claim 4, said cam member moving means further comprising a crank mounted on said shaft, and an actuator rod connected to said crank at an eccentric position and vertically movable for turning said shaft and said toothed wheel through said predetermined angle.

6. An apparatus according to claim 2, said spreading means further including means for closing and opening said grip members of each gripper, said closing and opening means comprising a pair of opposed projections disposed on said grip members of each said gripper at respective ends remote from their gripping ends, and a cam bar having a tapering cam end engaging said projections, said cam bar being movable between an advanced position in which said grip members of each said gripper are closed, and a retracted position in which said grip members of each said gripper are open.

7. An apparatus according to claim 6, including a pair of leaf springs acting on and urging said grip members of each said gripper toward its open position.

8. An apparatus according to claim 7, including a pushing bar slidably supported on said frame for pushing said cam bar to said advanced position, and an actuator lever pivotally mounted on said frame and pivotable between a "closing" position in which said pushing bar and thus said cam bar are moved to said advanced position, and an "opening" position in which said pushing bar and thus said cam bar are allowed to return to said retracted position.

9. An apparatus according to claim 8, including a cam sector mounted on said shaft and having a minor-diameter and a major-diameter cam portion, a roller carried on said actuator lever, and a spring acting on said actuator lever to urge said roller against said cam sector, said roller of said actuator lever, in response to the turning of said shaft and thus said cam sector through an angle, being rollable between said minor-diameter and major-diameter cam portions to cause said actuator lever to pivot between said "closing" and "opening" positions.

10. An apparatus according to claim 8, including a stop disposed adjacent to and downstream of said cam bar for restricting the movement of said cam bar in such a manner that said cam bar is moved from said retracted position to said advanced position when each said gripper holder with a respective one of said grippers is pivotally moved from said "neutral" position to said "spreading" position.

* * * * *